US007168925B2

(12) United States Patent
Humphries

(10) Patent No.: US 7,168,925 B2
(45) Date of Patent: Jan. 30, 2007

(54) AUTOMATIC OPTIMIZING PUMP AND SENSOR SYSTEM

(76) Inventor: James C. Humphries, 208 Haight St., Menlo Park, CA (US) 94025

( * ) Notice: Subject to any disclaimer, the term of this patent is extended or adjusted under 35 U.S.C. 154(b) by 69 days.

(21) Appl. No.: 10/659,074

(22) Filed: Sep. 11, 2003

(65) Prior Publication Data

US 2004/0047738 A1 Mar. 11, 2004

Related U.S. Application Data

(63) Continuation of application No. 09/858,830, filed on May 17, 2001, now Pat. No. 6,616,413, which is a continuation-in-part of application No. 09/272,935, filed on Mar. 20, 1999, now abandoned.

(60) Provisional application No. 60/078,743, filed on Mar. 20, 1998.

(51) Int. Cl.
*F04B 43/12* (2006.01)
*F04B 49/06* (2006.01)

(52) U.S. Cl. ..... 417/53; 417/44.1; 417/413.1

(58) Field of Classification Search ..... 417/53, 417/44.1, 44.11, 413.1
See application file for complete search history.

(56) References Cited

U.S. PATENT DOCUMENTS 2,930,324 A * 3/1960 Toulmin, Jr. ..... 417/413.1
3,635,592 A * 1/1972 Kolfertz ..... 417/413.1
3,671,151 A * 6/1972 Duke et al. ..... 417/411
3,819,305 A * 6/1974 Klochemann et al. ... 417/413.1
4,022,174 A * 5/1977 Brinkman ..... 123/448
4,154,559 A * 5/1979 Enomoto ..... 417/413.1
4,170,439 A * 10/1979 Hase ..... 417/413.1
4,498,850 A * 2/1985 Perlov et al. ..... 417/322
4,610,608 A * 9/1986 Grant ..... 417/413.1
4,697,989 A * 10/1987 Perlov et al. ..... 417/53
4,792,293 A * 12/1988 Wang ..... 417/571
4,877,378 A * 10/1989 Saggers ..... 417/299
4,899,582 A * 2/1990 O'Dougherty ..... 73/168
5,013,223 A * 5/1991 Takahashi et al. ..... 417/413.1
5,052,904 A * 10/1991 Itakura et al. ..... 417/363
5,066,204 A * 11/1991 Point et al. ..... 417/413.1
5,193,986 A * 3/1993 Grant et al. ..... 417/98
5,494,415 A * 2/1996 Morita ..... 417/412
5,520,517 A * 5/1996 Sipin ..... 417/44.3
5,630,710 A * 5/1997 Tune et al. ..... 417/326
6,354,817 B1 * 3/2002 Chang ..... 417/413.1
2004/0265150 A1 * 12/2004 McElfresh et al. ..... 417/413.1

* cited by examiner

*Primary Examiner*—William H. Rodriguez

(57) ABSTRACT

A reciprocating electromagnetic pump comprising a coil wound about a bipolar or tripolar core, a diaphragm structure mechanically coupled to at least one arm with a magnet attached to one end of the arm and a controller electronically connected to the coil. The controller comprises a pulse generator, a solid state switch that interrupts current flow through the pump electromagnet and additional electronic circuitry for signal processing. The arm is vibrated under the influence of a periodic electromagnetic field to produce the flow of gas. The flow of current through the electromagnet is interrupted so that the magnets are impelled during either a vacuum or a pressure stroke, but are not impelled during the reciprocal stroke. A signal produced in the electromagnet coil during the reciprocal is processed to provide feedback to control the pump drive frequency and phase to match the pump mechanical self-resonant frequency and phase under varying pumping loads. The signal can also be processed to provide a display of the pumping load and/or to provide feedback for control of the flow of gas.

20 Claims, 10 Drawing Sheets

Figure 2:
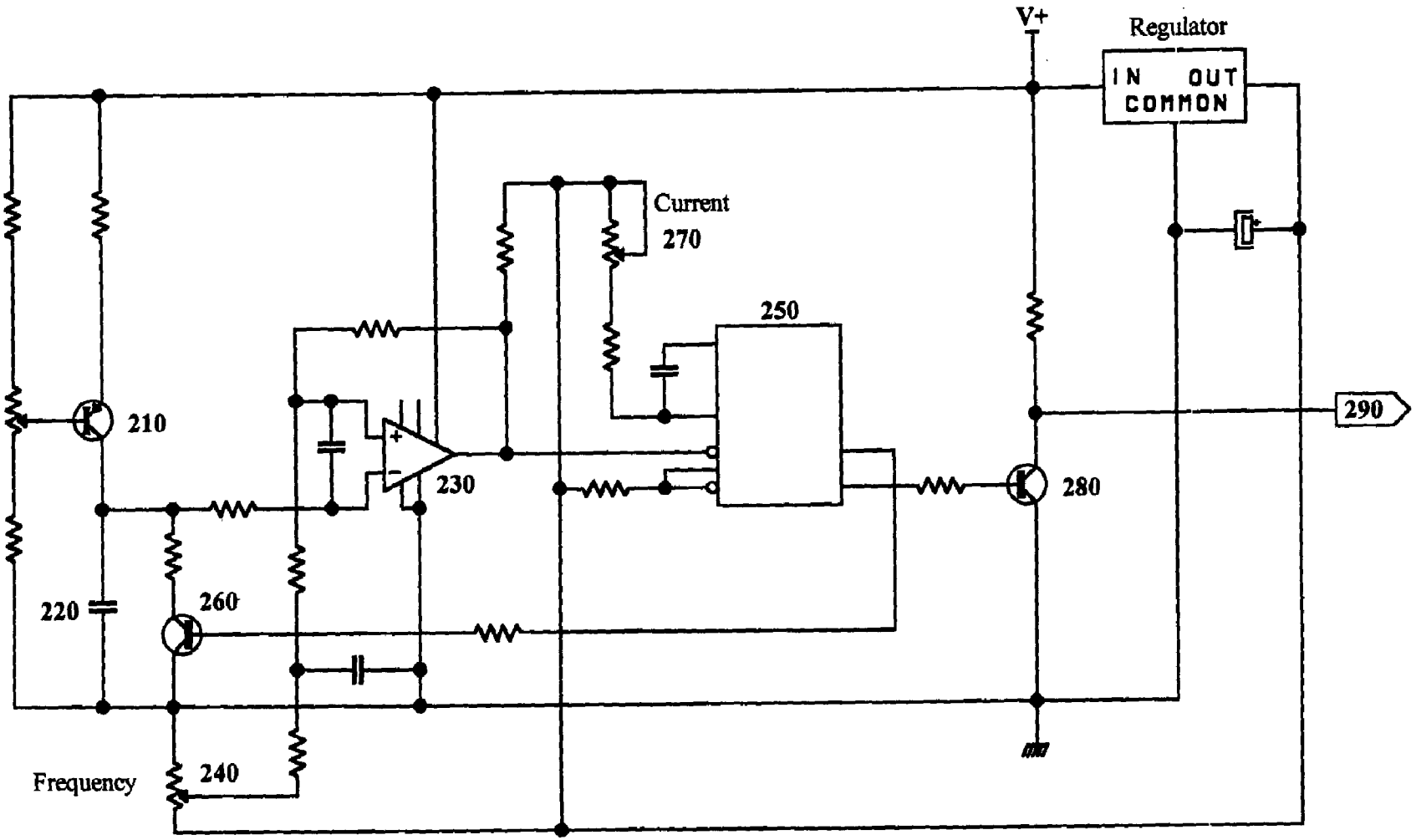

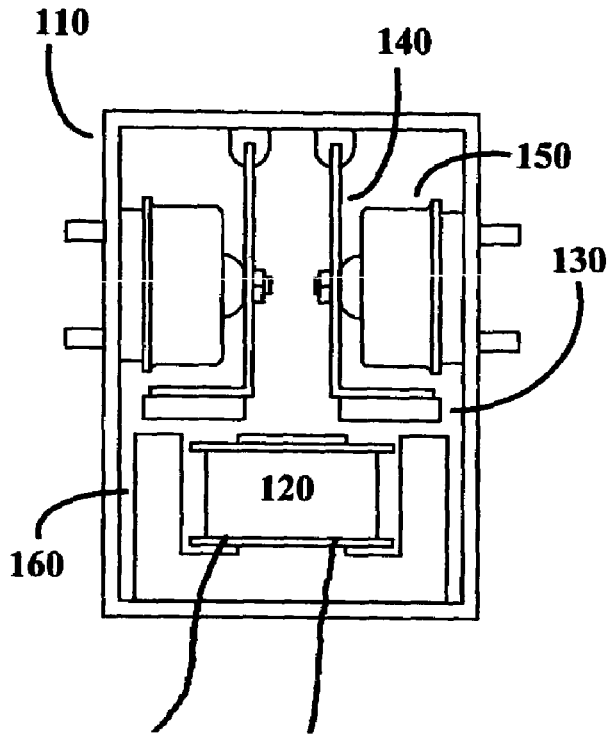
Figure 1-A
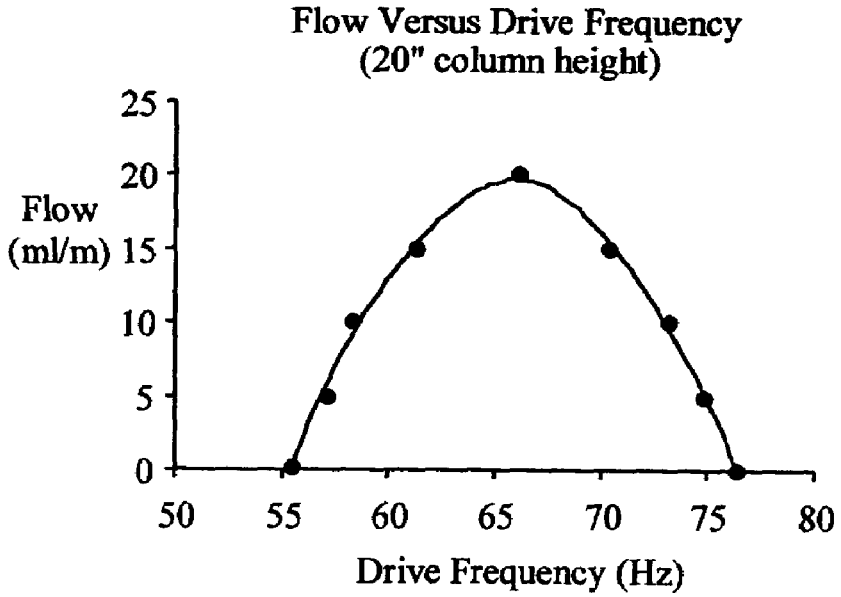
Figure 1-B

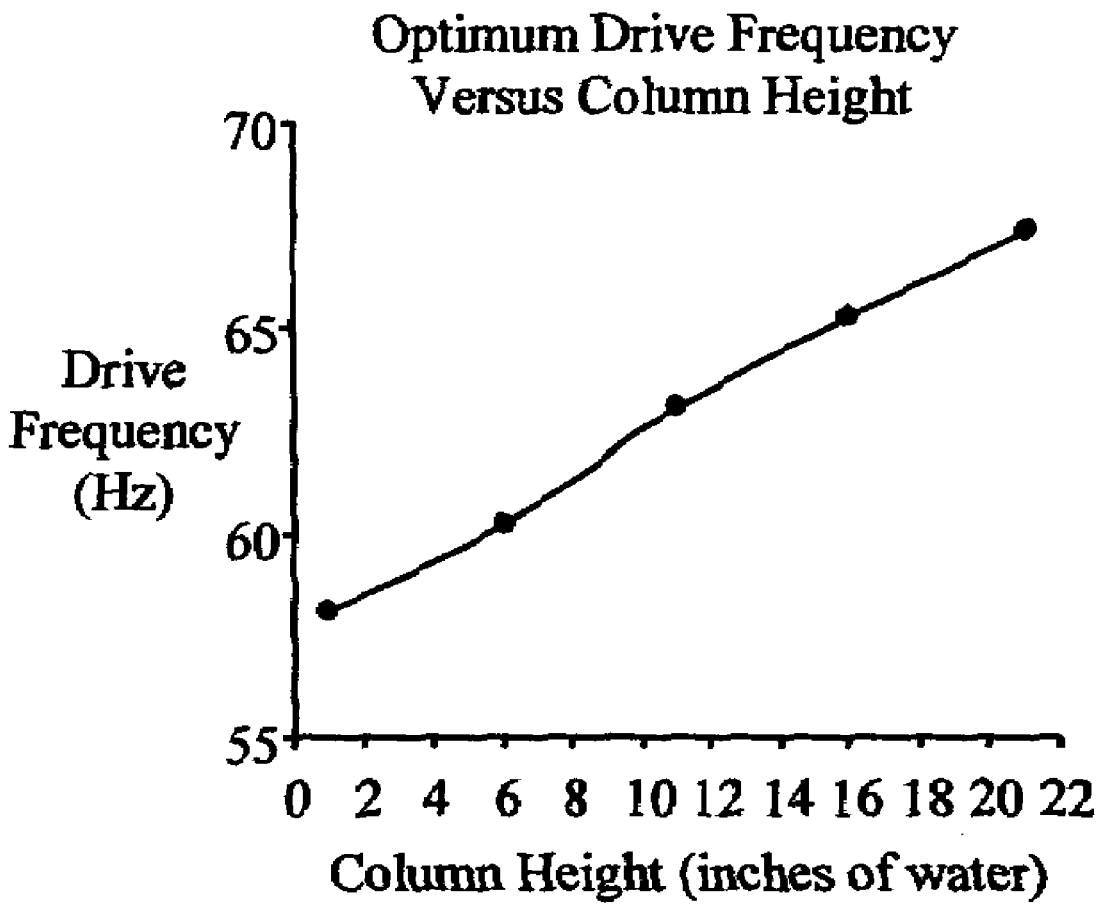
Figure 1-C

Optimum Drive Frequency
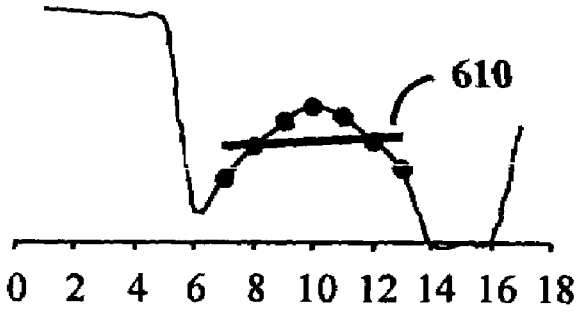
Figure 6-A
Low Drive Frequency
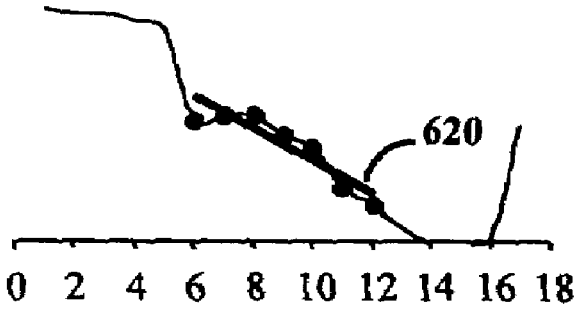
Figure 6-B
High Drive Frequency
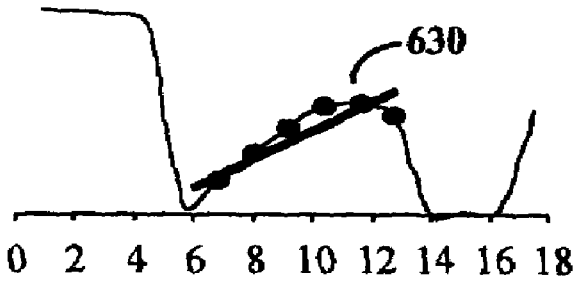
Figure 6-C

AUTOMATIC OPTIMIZING PUMP AND SENSOR SYSTEM

CROSS-REFERENCE TO RELATED APPLICATIONS

This application is a continuation application to U.S. application Ser. No. 09/858,830 filed on May 17, 2001, which issued as U.S. patent application Ser. No. 6,616,413, which is a continuation-in-part application to U.S. patent application Ser. No. 09/272,935 filed by the same inventor on Mar. 20, 1999, which is now abandoned, which claims the benefit of Provisional Application No. 60/078,743 that was filed on Mar. 20, 1998.

BACKGROUND OF THE INVENTION

This invention relates to method devices and system for fluidic pumps. More particularly it pertains to/gas pumps, gas flow control and fluid level sensing. This invention optimizes the efficiency of electromagnetic reciprocating pumps such as those described in U.S. Pat. No. 4,154,559, U.S. Pat. No. 4,170,439, and U.S. Pat. No. 5,052,904 (among others) by control of the pump driving frequency and drive current. Energy savings are realized in the pump operation by eliminating off-nominal pump drive conditions. In practice, electromagnetic reciprocating pumps are driven by the continuous 60 Hz sinusoidal AC service available from utility power companies (50 Hz in some countries other than the US). In their design and manufacture they are made to pump most efficiently at or near the utility power frequency when they are operating at or near the nominal conditions of their intended application range. As conditions vary from the nominal, efficiency and flow also vary. Off nominal pump performance may become so compromised that flow ceases well before the pump capacity is exceeded.

THE PROBLEM

The problems with prior art pumps is that they do not automatically optimize. By driving these pumps with periodic pulses rather than continuous sinusoidal current or by appropriately interrupting a continuous sinusoidal drive current, an opportunity is created in the interval when the drive current is off to monitor the voltage produced in the electromagnet coil by the returning motion of the magnet near the core poles. The voltage waveform thus produced can be analyzed to derive steering information for control of the drive frequency and drive current to optimize pump operation for varying conditions that fall within the pump performance limits. In addition, the voltage waveform can be analyzed to indicate the back pressure or pump load. For a given drive current, this indication has a consistent relationship to the height of the fluid column into which the pump is operating (based on the Least Squares Fit analysis, this relationship is linear). Thus the pump not only operates as a pump, but also as a level sensor. This method is scaleable and is applicable to similar pumps with higher or lesser capacities than those intended for the patent examples given above.

BRIEF SUMMARY OF THE INVENTION

The invention is the modification of the drive method for electromagnetic reciprocating pumps such as those described inter U.S. Pat. No. 4,154,559, by Hase U.S. Pat. No. 4,170,439, and by or Itakura U.S. Pat. No. 5,052,904.

By driving these pumps with periodic, pulsed current rather than continuous sinusoidal current, an opportunity is created in the interval between the drive pulses to monitor the voltage produced in the coil by the motion of the magnet(s) near the core poles.

All the prior art know to the applicant his attorney or the examiner has been made of record in the parent application to which this is a continuation in part. The invention enables electromagnetic reciprocating pumps to be used to sense the pumping load and, thus, fluid levels. The invention enables control of electromagnetic reciprocating pumps to deliver flow at a constant rate under varying pumping load conditions (varying fluid column heights into which the pump is operating).

Figure 3:
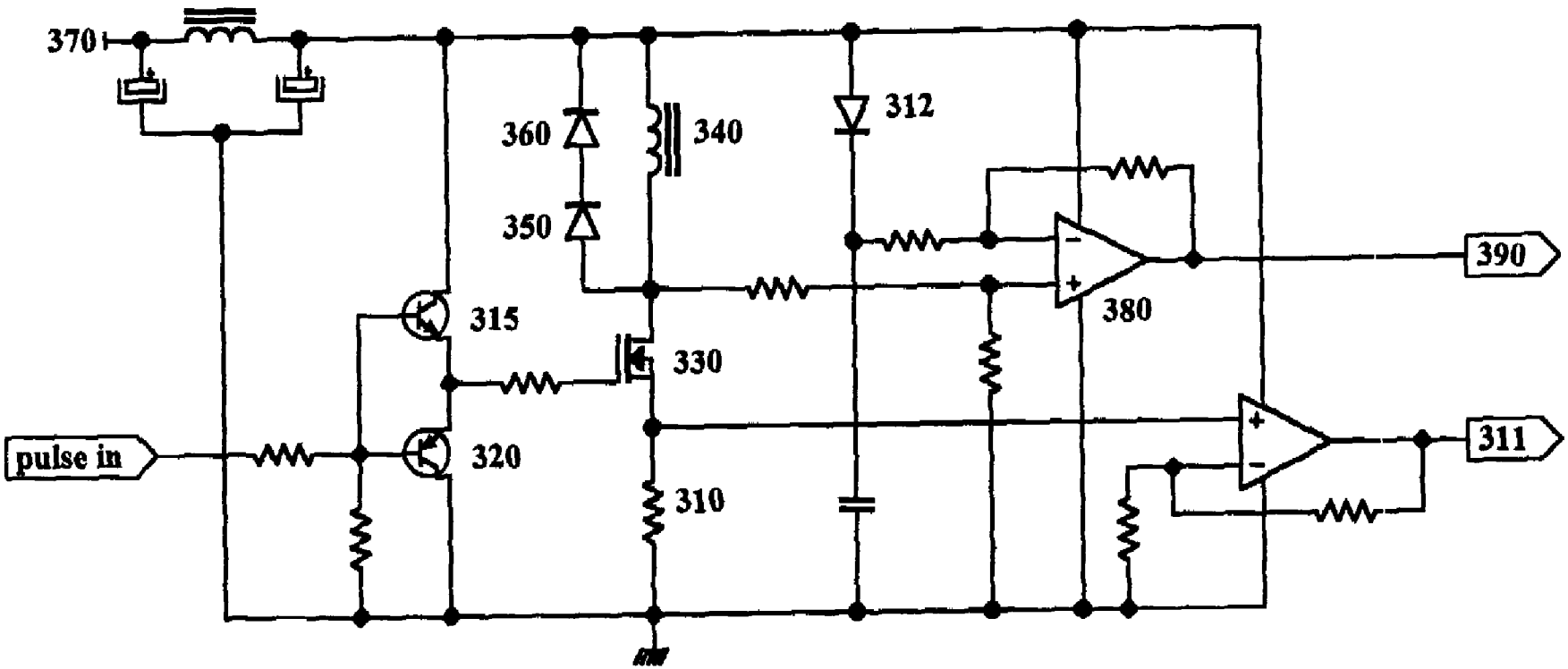
Figure 4:
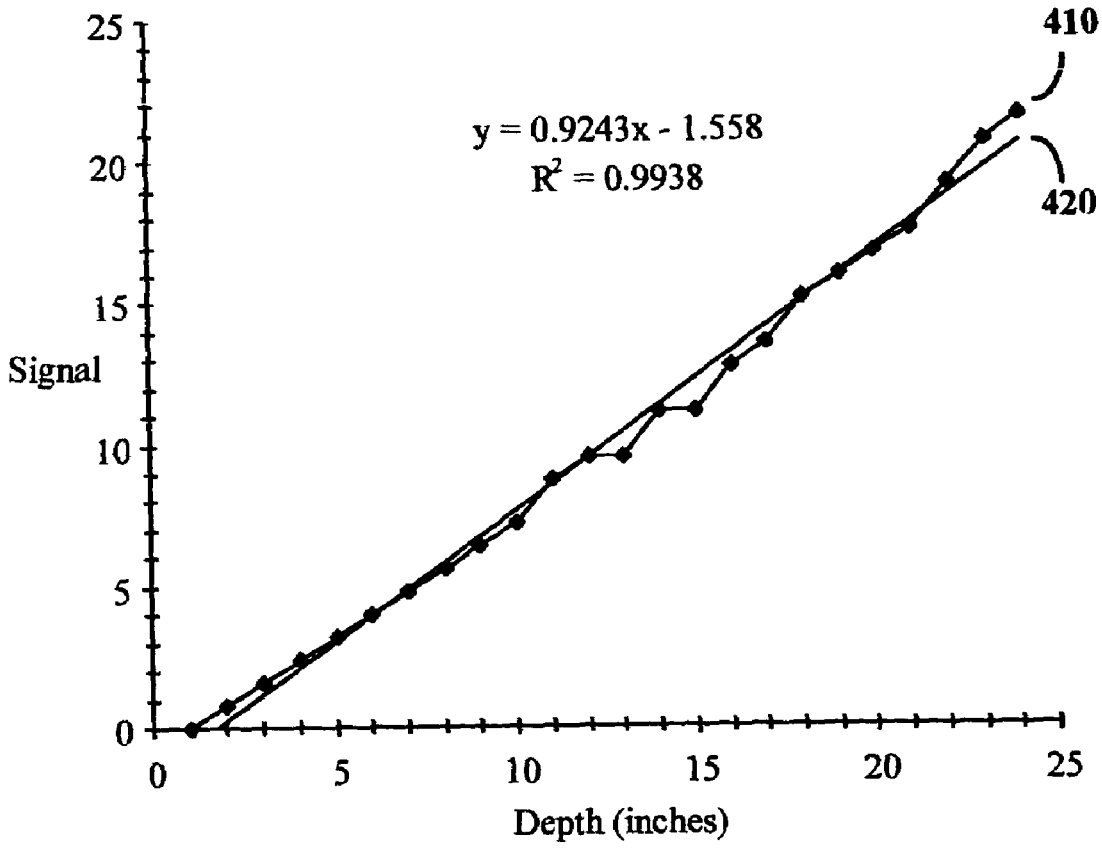
Figure 5:
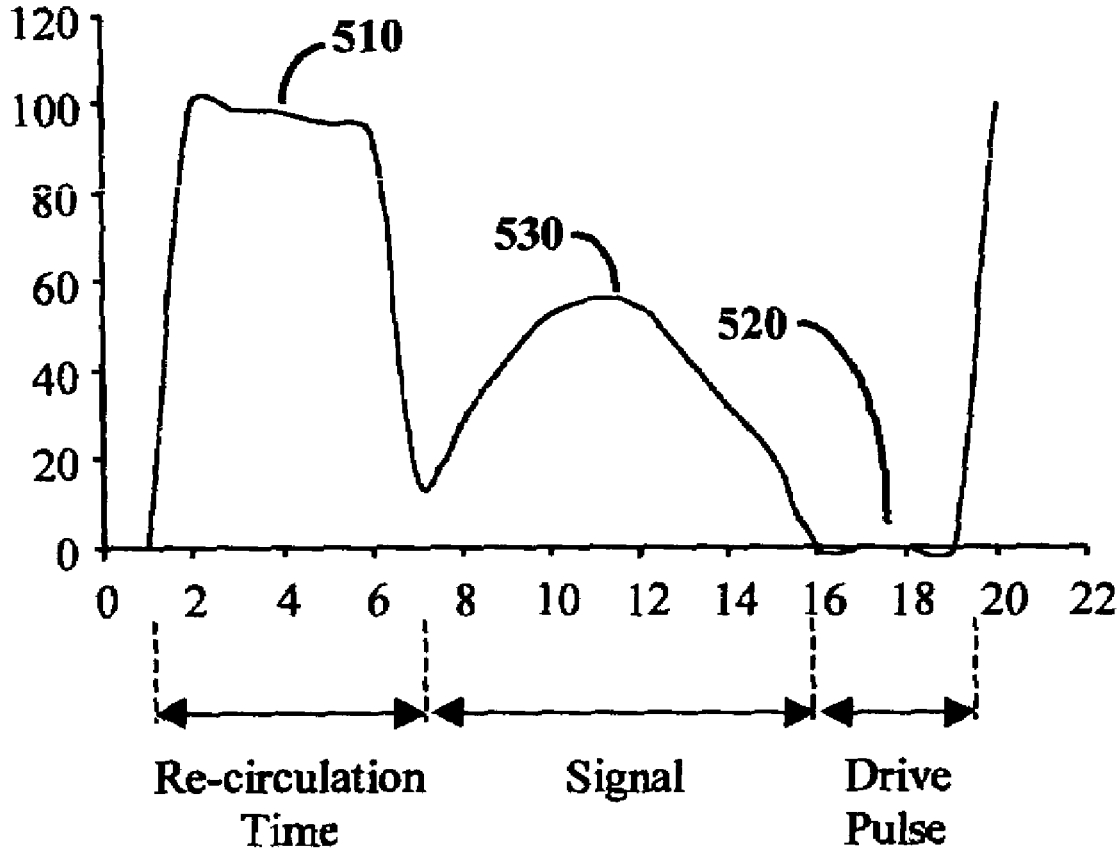
Figure 7:
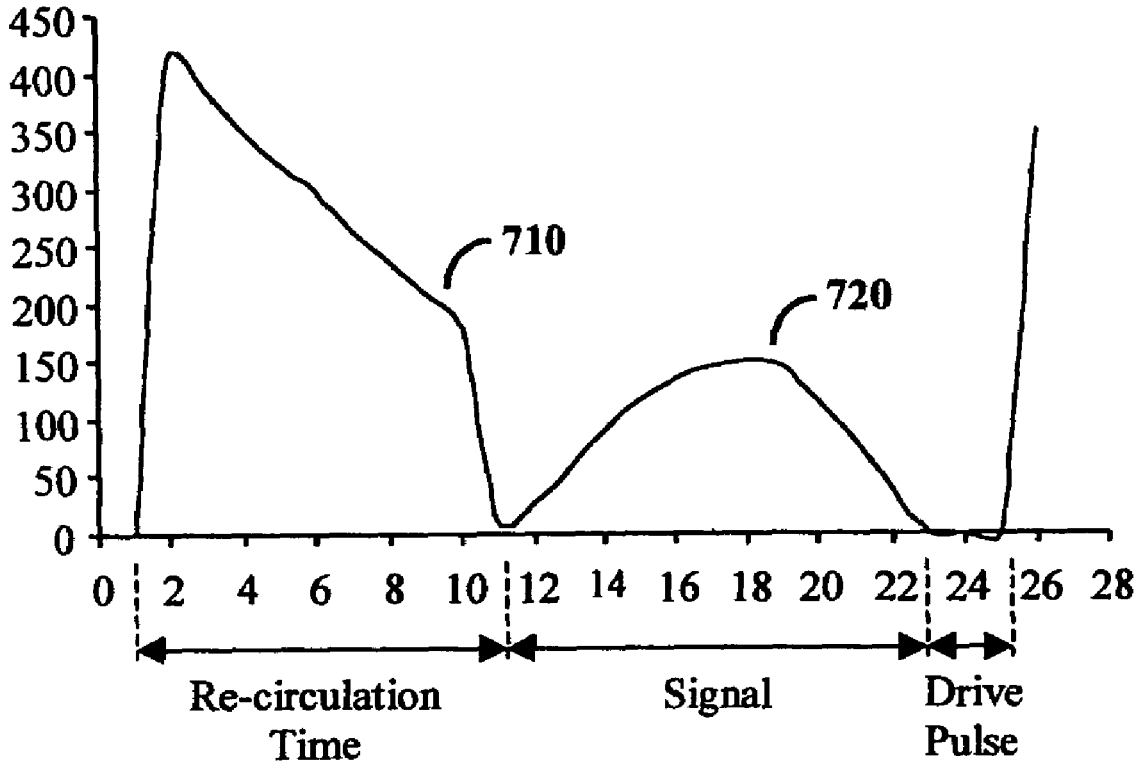
Figure 8:
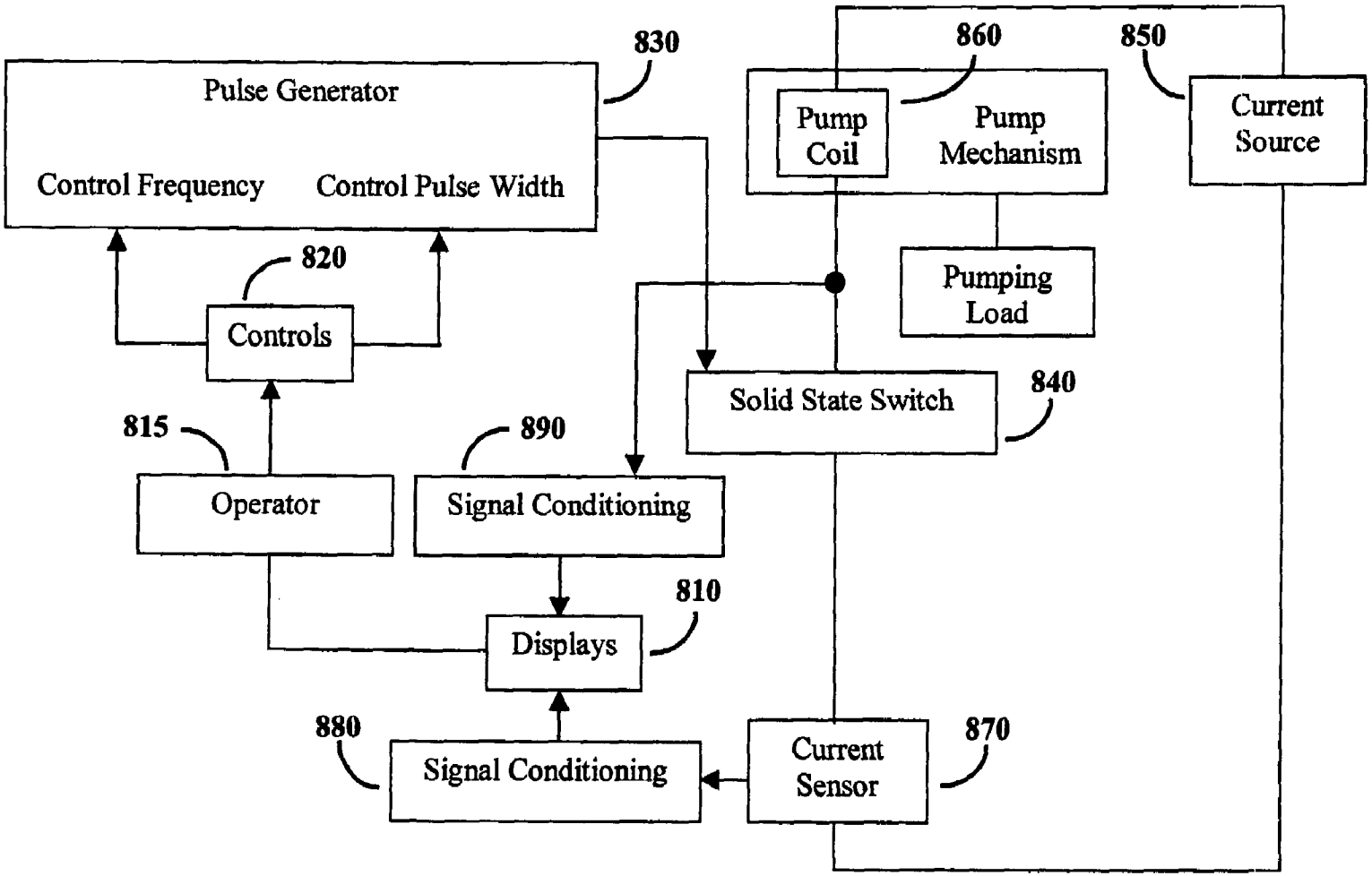
Figure 9:
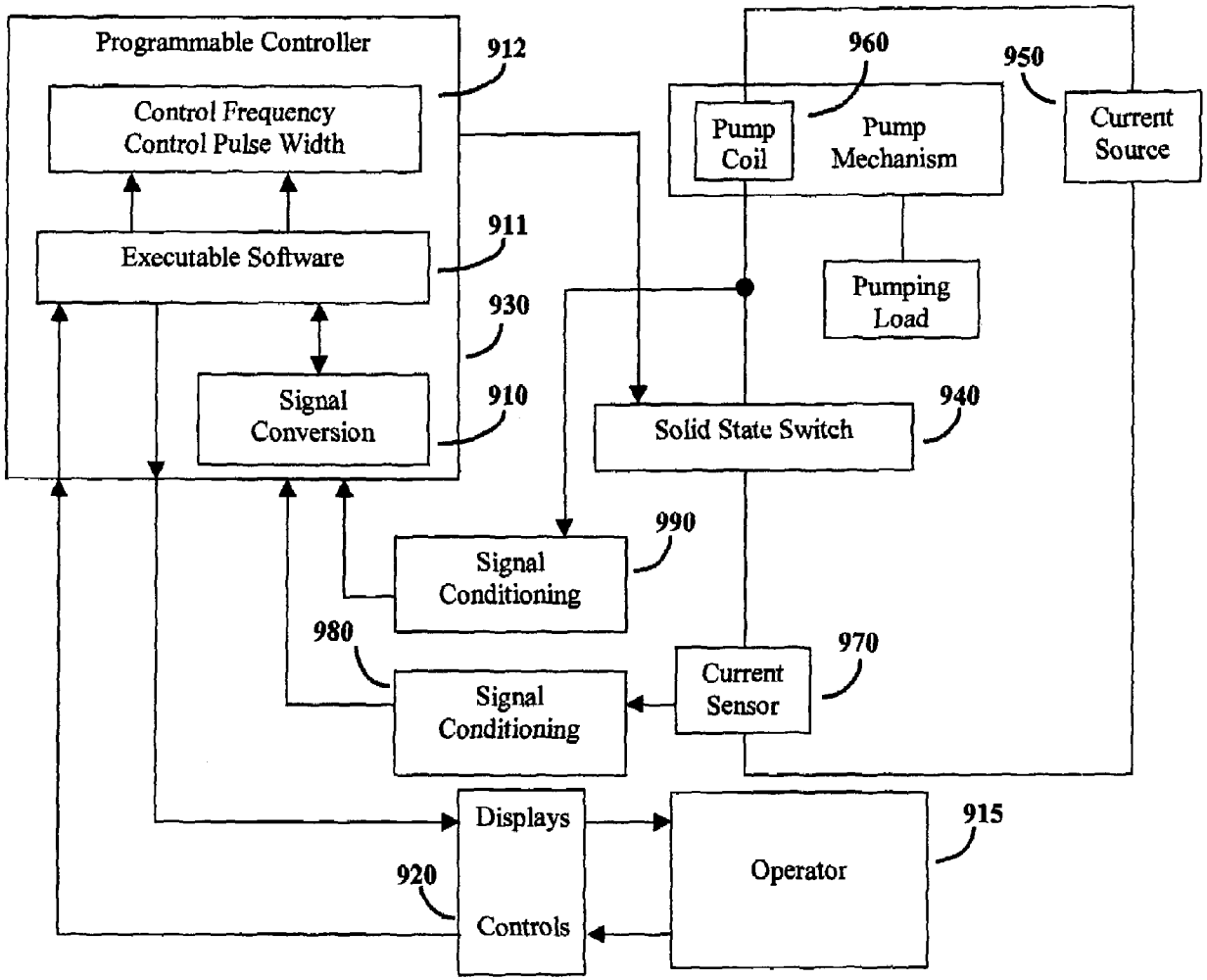

BRIEF DESCRIPTION OF THE SEVERAL VIEWS OF THE DRAWING a) FIG. 1-A is a block drawing of a representative electromagnetic reciprocating pump showing the major components.

b) FIG. 1-B is a graph showing the relationship between flow and drive frequency for the type of pump mechanism depicted in 1-A.

c) FIG. 1-C is a graph showing the relationship between pump load and the optimum drive frequency for the type of pump mechanism depicted in 1-A.

d) FIG. 2 is a drawing of representative circuitry for achieving pulsed drive with manual frequency and current (pulse-width) control.

e) FIG. 3 is a drawing of representative circuitry for driving the pump coil and for amplification and conditioning of the signal waveform.

f) FIG. 4 is a Microsoft Excel plot showing the relationship between the amplitude of the waveform of the signal produced by the return swing of the magnets and the fluid column height or pumping load.

g) FIG. 5 is a plot that shows representative components of the nominal signal waveform.

h) FIG. 6 shows various aspects of the signal waveform for a near-optimum drive frequency, a lower than optimum drive frequency and a higher than optimum drive frequency. FIG. 6 also shows Least Squares Fit trend lines for the portions of the signal that would be analyzed for automatic control.

i) FIG. 7 is a plot that shows representative components of the signal waveform when the pumping capacity is exceeded.

j) FIG. 8 is a block diagram of the major elements and configuration for manual control.

k) FIG. 9 is a block diagram of the major elements and configuration for automatic control.

DETAILED DESCRIPTION OF THE INVENTION

Automatic Optimizing Pump and Sensor System of this invention as shown in the drawings wherein like numerals represent like parts throughout the several views, there is generally disclosed in FIG. 1(*a*) drawing of a representative electromagnetic reciprocating pump showing the major components. FIG. 1-B is a graph showing the relationship between flow and drive frequency for the type of pump mechanism depicted in 1-A. FIG. 1-C is a graph showing the relationship between pump load and the optimum drive frequency for the type of pump mechanism depicted in FIG. 1-A.

Electromagnetic reciprocating pumps are mechanical resonators with the resonate frequency being determined by mechanical design, variations from design introduced during manufacturing and by pumping conditions.

In their principal application (aeration of aquariums to sustain aquatic life) these pumps are driven at the relatively constant frequency of the Alternating Current power line (60 Hz, US). The pumps are designed to be resonant at or near that frequency while the load conditions vary only slightly about a "nominal" level—a nominal height of the fluid column into which the pump is operating. As currently designed, manufactured and marketed, these pumps can only operate optimally when both the line frequency and fluid column height are at the nominal design values. Measurement indicates that the pump mechanism resonate frequency is strongly dependent on pump load conditions and that pumping efficiency—the rate of flow as a function of power consumption—is strongly influenced by the drive frequency.

Measurement also indicates that pumping efficiency decreases sharply when either the drive frequency or load conditions vary from the design nominal. Optimizing the pumping efficiency for a range of load conditions requires control of the drive frequency. Once the drive frequency is optimized, drive current can be reduced to produce required flow at the lowest possible power level.

The invention comprises a coil wound about a bipolar or tripolar core, a diaphragm structure mechanically coupled to at least one arm with a magnet attached to one end of the arm and a controller electronically connected to the coil. The arm is vibrated under the influence of a periodic electromagnetic field to produce flow. The flow of current through the electromagnet is interrupted so that the magnets are impelled during either a vacuum or a pressure stroke, but are not impelled during the reciprocal stroke. A microprocessor houses the controller which analyzes amplitude and frequency components of a signal produced in the electromagnet coil during the reciprocal stroke to provide a pump flow rate, a pumping efficiency, a pumping load and a height of the fluid column into which the pump mechanism is operating. The controller employs automatic feedback such that an operating frequency is controlled to match a self-resonant frequency of the pump and a coil current is controlled to a minimum value required to provide the desired flow.

The microprocessor further comprises a pulse generator and a solid state switch that interrupts current flow through a pump electromagnet. The voltage waveform can be analyzed to derive information for control of the drive frequency and drive current. The control can be used to optimize flow for a given operating power level, to optimize power consumption for a given required flow rate and/or to control flow rate for varying operating conditions that fall within the performance limits of the pump. In addition, the voltage waveform can be analyzed to indicate the static (or dynamic) pressure or pump load. For a given drive current, the voltage waveform has a consistent relationship to the height of the fluid column into which the pump is operating.

By modifying the drive method for an electromagnetic type pump such as those described in U.S. Pat. Nos. 4,154,559 and 4,170,439 the pump mechanism will also serve as a sensor. With the addition of a processing and control unit the pump/sensor configuration allows continuous automatic optimization of pumping efficiency as well as level sensing. The processing and control unit is a microprocessor with appropriate Input and Output capabilities and resident firmware or software that completes the implementation.

Many conventional electromagnetic air/fluid pump designs utilize diaphragms that are pulsated by an alternating mechanical force that is derived from the motion of permanent magnets under the influence of an alternating magnetic field. To produce the field, a coil is wound on either a bipolar or tripolar iron core and driven by an alternating electric current. The permanent magnet is alternately attracted to and repelled by the core pole(s).

Referring to FIG. 1-A, various refinements to the pump structure have been made to reduce vibration, noise and/or to increase the number of ports but the basic configuration comprises: a frame 110 that mechanically integrates the pump components; a coil 120 and core 160 electromagnet assembly; a permanent magnet 130 affixed to the end of the drive arm near the electromagnet 120, 160; a drive arm 140 with the end opposite the magnet affixed to flexible pivot point; and a diaphragm pump 150 attached to the frame 110 and to the drive arm 140 such that as the arm 140 vibrates the diaphragm 150 pulsates and produce flow. Valves and ports integral to the diaphragm 150 are not differentiated or labeled.

In practice, these pumps are driven by the continuous 60 Hz sinusoidal AC service available from utility power companies (50 Hz in some countries other than the US). In their design and manufacture they are made to pump most efficiently at or near the utility power frequency when they are operating at or near the nominal conditions of their intended application range. As conditions vary from the nominal, efficiency and flow also vary. Off nominal pump performance may become so compromised that flow ceases well before the pump capacity is exceeded.

To illustrate, FIG. 11-B shows the effect on flow as the drive frequency is varied above and below the nominal value for a 20 inch water column load condition. In FIG. 11-B, drive frequency is plotted along the horizontal (X) axis and flow (in milliliters/minute) is plotted along the vertical (Y) axis. Referring to FIG. 11-B, note that Flow is reduced by 25% as the drive frequency is varied by about 7% off the nominal. FIG. 1-C shows the relationship between pumping load and the optimum drive frequency. In FIG. 1-C, drive frequency is plotted along the vertical (y) axis and column height (in inches of water) is plotted along the horizontal (X) axis.

By driving these pumps with periodic pulses rather than continuous sinusoidal current (or by appropriately interrupting a sinusoidal current), an opportunity is created in the interval between the drive pulses to monitor the voltage produced in the coil 120 by the returning motion of the magnet 130 near the core poles 160.

FIG. 2 shows representative circuitry for providing drive pulses of varying frequency and widths. Transistor 210 is configured as a constant current source charging capacitor 220. Voltage comparator 230 compares the charge voltage on capacitor 220 and the level set by the potentiometer control 240 labeled "Frequency". When the charge level of capacitor 220 and the level set by control 240 are equal the a stable multivibrator (one-shot) 250 is triggered and produces a pulse with a duration set by potentiometer control 270 labeled "Current". Concurrently, transistor 260 discharges capacitor 220 to cause the cycle to repeat. The a stable multivibrator output pulse is buffered by transistor 280 in an open collector configuration. The buffered output 290 drives the complimentary current amplifier comprised of transistors 315 and 320 shown in FIG. 3. The current amplifier provides a high gate charging rate and rapid gate discharging rate for the solid state switch 330 that interrupts current flow from the current source 370 through the pump electromagnet 340, 120, 160 (an inductor). Source current 370 flows through 340, 120 when 330 is in the on condition (conducting). Current flow is interrupted when 330 is in the off condition (non-conducting).

When current flow through 340, 120 is interrupted by 330, catch diodes 350 and 360 allow fly-back current to re-circulate through the electromagnet coil 340, 120 as the magnetic field collapses in the electromagnet core 160. When the magnetic field has collapsed, all of the driving force to the permanent magnet 130 is expended, allowing the permanent magnet 130 to swing back past the electromagnet 120, 340 core 160 propelled by the returning force of the drive arm 140 and the spring force stored as back pressure in the pump diaphragm 150. As the permanent magnet 130 swings back past the electromagnet 120, 340 core 160 a voltage is induced in the electromagnet coil 340.

The voltage (signal) thus produced can be analyzed to derive steering information for control of the drive frequency 240 and drive current 270 to optimize flow for operating conditions within the performance limits of the pump. In addition, the signal can be analyzed to indicate the back pressure or pump load. For a given drive current, this indication has a consistent relationship to the height of the fluid column into which the pump is operating. This relationship 410 is shown in FIG. 4 with the fluid column height plotted along the X axis and the signal amplitude plotted along the Y axis. Based on the Least Squares Fit straight line 420, this relationship appears to be linear. Thus the pump not only operates as a pump, but also as a level sensor.

Several prototypes have been constructed to verify the practicality of this method. Pump electromagnet coils 120, 340 were rewound to achieve adequate magnetic flux with a low operating voltage (12 Volts, typical)—although higher voltage operation is perfectly applicable.

The drive circuitry (FIGS. 2 and 3) and pump (FIG. 1-A) were powered by a 12 Volt power supply with a current capacity of 20 Amperes. The signal was clipped, amplified and level shifted by additional circuitry shown in FIG. 3 to make viewing on an oscilloscope display more convenient. In FIG. 3, amplifier 380 produces a signal 390 that is the difference between the opposing electrical ends of the electromagnet coil 120, 340. In this way, amplifier 380 removes the major common voltage that exists when switch 330 is open.

Amplifier 380 clips the signal to a zero potential when switch 330 is closed. Bias diode 390 provides a small amount of level shifting to assure that none of the signal of interest is clipped. The waveforms shown in FIGS. 5, 6 and 7 were obtained by processing acquired data within Microsoft Excel to approximate the action of the pre-processing circuitry shown in FIG. 3 (data were offset, inverted, scaled and clipped).

FIG. 5 shows a representative (nominal) waveform derived from data acquired during pump operation and processed using Microsoft Excel. In FIG. 5, time is displayed along the X axis and signal amplitude is displayed along the Y axis. The re-circulation time waveform 510 and the drive pulse waveform 520 provide landmarks for the Operator that help in assessing the effects of adjustment of the frequency control 240 and the current control 270. The signal of interest 530 appears between the re-circulation time waveform 510 and the drive pulse waveform 520.

The electromagnet peak current was measured both by a current probe and by monitoring the voltage developed across a 0.1 Ohm resistor 310 connected between the electromagnet solid state switch transistor 330 emitter/source and circuit ground. Bipolar and Metallic Oxide Semiconductor Field Effect (MOSFET) driver transistors have been used with good success. In the preferred embodiment the solid state switch transistor 330 shown in FIG. 3 is a MOSFET.

Trial and error resulted in adoption of a two-diode 350 and 360 catch scheme for the electromagnet coil. One catch diode is normally used but multiple catch diodes shorten the current circulation time at fly-back by allowing a larger fly-back voltage to develop. During the time that the catch diodes are conducting 510, the signal of interest is masked. Two catch diodes 350 and 360 has proven to be a good compromise between efficient use of the energy stored in the electromagnet core 160, 340 and unmasking of signal of interest 530.

With the modified pump electromagnet and prototype drive circuitry, measurement confirmed that frequency control can be used to optimize the pump efficiency (as measured by flow rate) over a wide range of pumping loads.

Measurement also confirmed that the 60 Hz pumps tested were not necessarily most efficient at 60 Hz even at their nominal loading conditions. Observation with an oscilloscope confirmed that the signal produced by the return swing of the magnets was visible between drive pulses if the pulses were suitably short and that the length of the fly-back or re-circulation time is critical—too long and the signal of interest is masked. Observation also confirmed that the shape of the waveform of the signal produced by the return swing of the magnets is a function of drive current, pump load and drive frequency. Analysis using Microsoft Excel also confirmed that the waveform of the signal produced by the return swing of the magnets can be processed to produce feedback control to optimize the drive frequency and current.

FIG. 5 is a representative plot of the components of the nominal signal waveform. Proceeding from left to right; division 1 on the horizontal axis corresponds to the end of the drive pulse and beginning of the time that current recirculates in the electromagnet 120, 160, 340. Division 7 on the horizontal axis corresponds to the end of the re-circulation time and the beginning of the return swing of the armature magnets 130. Division 16 on the horizontal axis corresponds to the end of the return swing and the beginning of the next drive pulse. The interval between division 1 and division 19 on the horizontal axis is the time between drive pulses (the reciprocal of the drive frequency).

FIG. 6 waveform data were acquired by hand using the cursor acquisition feature of a Tektronix model 468 oscilloscope. The data were then entered into Microsoft Excel spreadsheets and analyzed and plotted. Least Squares Fit straight lines 610, 620 and 63 were calculated and plotted along with the waveform data. The slope of the fitted lines 610, 620, 630 varied with pump loading and changed sign on either side of the self-resonant (optimum) condition. FIG. 6-A shows a near-nominal waveform with peak of the sinusoid roughly centered between the end of the recirculation time and the beginning of the drive pulse. Note that the slope of the Least Squares Fit line 610 for the data in the signal interval is near zero.

FIG. 6-B shows a waveform that obtains from too high a drive frequency. Note that the slope of the Least Squares Fit line 620 for the data in the signal interval is negative. FIG. 6-C shows a waveform that obtains from too low a drive frequency. Note that the slope of the Least Squares Fit line 630 for the data in the signal interval is positive.

Once optimized, the amplitude of the waveform of the signal produced by the return swing of the magnets 130 is proportional to the pumping load for a specific drive current. Measurement and analysis confirms that the amplitude of the waveform of the signal 530 produced by the return swing of the magnets 130 near the electromagnet core 160 is proportional to the fluid column height or fluid level as described earlier. The relationship 41 shown in FIG. 4 has a Least Squares Fit straight line 420 with a coefficient of fit 430 (R') that is close to 1.0. Data were taken while the pump air line outlet depth was increased roughly every inch in a 24-inch high water column. The peak drive current was approximately 2 Amperes (average drive current approximately 0.150 Amperes).

Calibrating the system for fluid column height is straightforward in that both intercept and slope can be derived from two or more data points. The constants are acquired by recording and analyzing the nominal condition waveforms (for one or more current settings) while pumping into free air and into a fluid column with the maximum anticipated column height (e.g., empty tank, full tank).

As the column height is increased flow eventually stops when there is insufficient drive current. The column height and drive current can be increased up to a point where the maximum pumping capacity is exceeded. This condition is equivalent to a clogged air line and it results in a unique waveform where the ending value of the fly-back voltage is equal to (or nearly equal to) the peak value of the waveform between the landmarks described earlier. This clogged condition can be detected automatically and the problem annunciated.

FIG. 7 is a representative plot of the drive and signal components of the waveform when the pumping capacity is exceeded. The off-nominal characteristic of the signal waveform in FIG. 7 is the ending amplitude of the re-circulation voltage 710 that approximately equals the peak level of the return swing signal 720.

Manual Operation

By manually adjusting the drive frequency 240 in proportion to the slope and sign of the Least-Squares-Fit straight lines 610, 620, 630 flow could be optimized for varying operating conditions. In manual operation both the operating drive frequency and drive current are set manually by manipulating the potentiometer controls 240 and 270 shown in FIG. 2 (labeled "Frequency" and "Current", respectively). In practice, the "Frequency" control 240 is set to a beginning value that corresponds to the nominal self resonant frequency of the pump mechanism as represented in FIGS. 1-A and 1-B (60 Hz is typical). Conventional means for monitoring the drive frequency can be used including a digital frequency meter or by observation of the interval between drive pulses on an oscilloscope display.

The beginning drive current is set by control 270 to any value that is below the saturation level for the pump electromagnet 120, 160, 340. Conventional means for monitoring the drive current can be used including a current probe and/or by observing the voltage developed across the current sensing resistor 310 shown in FIG. 3 on an oscilloscope display. The preferred means of display for manual control has been to show both the "signal" 390 in FIG. 3 and the "current" 311 in FIG. 3 concurrently on separate channels of a single oscilloscope, the oscilloscope time base being synchronized to the drive pulses produced at the output 290 of the pulse generator shown in FIG. 2. The resulting display(s) provide an Operator with the information necessary for pump optimization and for deriving the height of the fluid column into which the pump is operating. The signal and current waveforms are enhanced for display (and for signal processing) by the circuitry shown in FIG. 3.

FIG. 8 represents the process flow for manual control. The Operator 81 manipulates the frequency and current controls 820, 240, 270 of the pulse generator 830 driving the solid state switch 840, 330 that interrupts current flow from source 850 through the pump electromagnet 860, 340, 160, 120. Signals generated by the current sensing resistor 870, 310 and the pump coil 860, 340, 120 are conditioned for display on an oscilloscope 810 by circuitry 870 and 880 respectively. The Operator 815, by observing the displayed waveforms 810, further manipulates the controls 820, 240, 270 to achieve the pumping optimization, the desired rate of flow and/or the Operator derives from measurements of the signal waveforms the height of the fluid column into which the pump is operating. In this way the pump control loop is closed through the Operator.

Automatic Operation

For automatic operation, manual control of the operating frequency and operating current is augmented by a programmable controller (i.e., a microprocessor) that incorporates the means to digitize and analyze the signal waveforms and to generate drive pulses at varying frequencies and of varying widths in relation to the analysis results and to parameters that are established by the Operator. FIG. 9 represents the process flow for automatic operation. The Operator 915 enters parameters for the desired controlled conditions via controls and displays 920 (alpha/numeric keypad, LCD alpha/numeric display, typical). The controller 930 outputs pulses at a beginning nominal frequency and width to the solid state switch 940, 330 that interrupts current from source 950 through the pump electromagnet 960, 340, 160, 120. Signals generated by the current sensor 970, 310 and the pump coil 960, 340, 120 are conditioned by circuitry 980 and 990 respectively. The circuitry delineated in FIG. 3 is merely representative. The conditioned signals are digitized by elements 910 contained within the controller 930, analyzed according to appropriate algorithms embodied in the executable software 911 and appropriate adjustments are automatically made to either or both the operating frequency and operating current 912.

BEST MODE PREFERRED EMBODIMENT

The preferred embodiment of the invention includes a reciprocating electromagnetic pump mechanism comprising one or more arms with magnet(s) attached to one end of the arm(s) such that the arm(s) may be vibrated under the influence of an electromagnetic field, that field being produced by the periodic flow of current in a coil wound about a bipolar or tripolar core. The vibration of the arm(s) being mechanically coupled to diaphragm(s) incorporating valves and ports such that a vacuum is created at one port and, simultaneously, a pressure is created at another port. The time the current flows through the coil is made to be short so that the magnets are impelled during either the vacuum or pressure stroke but are not impelled during the reciprocal stroke, the reciprocal stroke being completed by the spring energy stored in the arm/magnet/diaphragm system During the reciprocal stroke the motion of the magnet(s) near the core induces a voltage in the coil that is proportional to the velocity and the position of the magnet(s) traversing the core pole(s). The amplitude and frequency components of the signal thus produced can be analyzed by manual or automatic means to provide unequivocal indications of the pump flow rate, the pumping efficiency, and the height of the fluid column into which the pump is operating. Feedback is employed by manual or automatic means such that the operating frequency is controlled to match the pump self-resonant frequency and the coil current is controlled to a constant and appropriate value, the pumping load or fluid column height can be known by measurement of the signal amplitude. The operating frequency is controlled to match the pump self-resonant frequency. The pumping efficiency can be optimized by control of the coil current to produce the highest possible flow rate for a given operating power level. The operating frequency is controlled to match the pump self-resonant frequency. The fluid column height being known by measurement of the signal amplitude for a given coil current and the coil current being otherwise controlled to produce and maintain the signal amplitude at a desired level, the flow rate can be made constant for varying pumping loads.

The means for driving the coil of the reciprocating electromagnetic pump mechanism comprises a pulse generator and a solid state switch (or switches) that interrupts current flow through the pump electromagnet. The operating current of the pump electromagnet (the electromagnet being an inductor) is proportional to the time that current flows through it. The pulse generator is embodied in a microprocessor with display(s) and controls and executing suitable software such that pulses are produced at an output, the pulse frequency and the pulse width being controlled manually or automatically. Manual or automatic control employing feedback are implemented through additional facilities embodied in the same microprocessor such that signals are digitized and analyzed so that the fluid column height is measured and displayed and/or the pumping efficiency is manually or automatically optimized to produce the highest possible flow rate for a given operating power level and/or the flow rate is manually or automatically made constant for varying pumping loads.

Alternate Emdbodiment

A further embodiment of the present invention can be an alternate-operating mode that improves the utilization of drive power (improving pumping efficiency and capacity).

The alternate mode involves substituting an "H" bridge for the simpler "open collector" or "open drain" type driver. With the "H" bridge, the pump mechanism can be driven on both strokes. Since driving on both strokes will mask the signal, closed loop control is achieved by periodically driving on only one stroke, processing the resulting signal and setting the drive frequency and current for some number of succeeding "both stroke" cycles. This mode changes (increases) the control-loop time constant and may be inappropriate for some applications but it would be fine for "optimizing" and measuring with (more) slowly changing pumping loads.

An example of a more slowly changing pumping load application would be liquid holding tank level sensing where changes in level occur relatively slowly. I would think a practical implementation for this mode would be 10 or more "both stroke" drive cycles followed by one single stroke drive and measurement cycle, and so on. The "H" bridge phasing to accomplish this would be easily handled by the microprocessor already in the control loop.

For optimizing the aeration of a fish tank, either to control the level of oxygenation and compensate for slowly varying water column heights (evaporation) or to consume the minimum power possible to deliver a required level of oxygenation (for power savings), or both, it might be practical to go thousands of drive cycles before taking a measurement. For this particular application it would also be desirable to operate the mechanism and control circuitry at power line voltage levels. This would not be a problem.

Two additional improvements in the electromagnet can be:

1) Profiling of the electromagnet pole faces to from an arc that permits maintaining a small and constant gap between the poles and the permanent magnets that are attached to the swing arms. This makes more efficient use of the flux developed by the electromagnet.

2) Selection of the electromagnet core material permeability to match the short duration of the drive pulse—that is, select a material that will allow flux to build more rapidly than the soft iron typically used. This would result in a shorter time for collapsing of the magnetic field and has, a shorter recirculation time of the back EMF through the coil and hunt diodes. The shorter recirculation time would allow more of the signal to be observed when the pumping loads are in the higher range (where he optimum frequency for the pump drive is in the higher range).

Due to the simplicity and elegance of the design of this invention designing around it is very difficult if not impossible. Nonetheless many changes may be made to this design without deviating from the spirit of this invention. Examples of such contemplated variations include the following:

a) The shape and size of the various members and components may be modified.
b) The power, capacity, aesthetics and materials may be enhanced or varied.
c) Additional complimentary and complementary functions and features may be added.
d) state switch means may be employed for interrupting current flow through the electromagnet coil)
e) Permanent magnets and electromagnet (stationary permanent magnet and moving electromagnets) may be interposed.
f) Other changes such as aesthetics and substitution of newer materials as they become available, which substantially perform the same function in substantially the same manner with substantially the same result without deviating from the spirit of the invention may be made.

While this invention has been described with reference to illustrative embodiments, this description is not intended to be construed in a limiting sense. Various modifications and combinations of the illustrative embodiments as well as other embodiments of the invention will be apparent to a person of average skill in the art upon reference to this description. It is therefore contemplated that the appended claim(s) cover any such modifications, embodiments as fall within the true scope of this invention.

The inventor claims:

1. A pump system comprising:
a power source;
a pump;
an electromagnet assembly that drives the pump;
a controller that controls the power source to power the electromagnetic assembly with periodic electronic pulses, and that monitors a signal produced in the electromagnet to determine when a next electronic pulse will occur; and
a sensor that senses an impulse response of the pump to the electronic pulses so that at least one of an amplitude and frequency component of an oscillation can be detected.

2. The pump system of claim 1, further comprising the controller driving the pump system to pump a gas so that the at least one of the amplitude and frequency component is reflective of a pumping load.

3. The pump system of claim 2, further comprising the controller continuously determining a value using the at least one of the amplitude and frequency component that is reflective of the pumping load.

4. The pump system of claim 3, further comprising the controller using the value to increase or decrease a width of the next periodic electronic pulse so that a pump pressure can be controlled.

5. The pump system of claim 4, further comprising the controller using the value to increase or decrease a width of the next periodic electronic pulse so that a pump flow rate can be controlled.

6. The pump system of claim 1, further comprising the controller determining that the next electronic pulse will occur a half-cycle after a previous electronic pulse.

7. The pump system of claim 1, further comprising the controller determining that the next electronic pulse will occur a full-cycle after a previous electronic pulse.

8. A method of using a pump system having a power source, a pump and an electromagnet assembly comprising:

driving the pump using the electromagnet assembly;

controlling the power source to power the electromagnetic assembly with periodic electronic pulses, and monitoring a signal produced in the electromagnet assembly to determine when a next electronic pulse will occur; and sensing an impulse response of the pump to the electronic pulse so that at least one of an amplitude and frequency component of an oscillation can be detected.

9. The method of claim 8, further comprising controlling the pump system to pump a gas so that the at least one of the amplitude and frequency component is reflective of a pumping load.

10. The method of claim 9, further comprising continuously determining a value using the at least one of the amplitude and frequency component that is reflective of the pumping load.

11. The method of claim 10, further comprising using the value to increase or decrease a width of the next periodic electronic pulse so that a pump pressure can be controlled.

12. The method of claim 11, further comprising using the value to increase or decrease a width of the next periodic electronic pulse so that a pump flow rate can be controlled.

13. The pump system of claim 8, further comprising determining that the next electronic pulse will occur a half-cycle alter a previous electronic pulse.

14. The pump system of claim 8, further comprising the controller determining that the next electronic pulse will occur a full-cycle after a previous electronic pulse.

15. A method pumping a gas comprising:

driving a pump using an electromagnet assembly;

controlling a power source to power the electromagnetic assembly with periodic electronic pulses, and monitoring a signal produced in the electromagnet assembly to determine when a next electronic pulse will occur; and sensing an impulse response of the pump to the electronic pulses so that at least one of an amplitude and frequency component of an oscillation can be detected.

16. The method of claim 15, further comprising pumping a gas so that the at least one of the amplitude and frequency component is reflective of a pumping load.

17. The method of claim 16, further comprising continuously determining a value using the at least one of the amplitude and frequency component that is reflective of the pumping load.

18. The method of claim 17, further comprising using the value to increase or decrease a width of the next periodic electronic pulse so that a pump pressure can be controlled.

19. The method of claim 18, further comprising using the value to increase or decrease a width of the next periodic electronic pulse so that a pump flow rate can be controlled.

20. The pump system of claim 15, further comprising determining that the next electronic pulse will occur at one of a half-cycle of oscillation and a full-cycle of oscillation after a previous electronic pulse.

* * * * *